United States Patent [19]

Brennan

[11] 4,294,693

[45] Oct. 13, 1981

[54] AIR FLOTATION ORE ENRICHING APPARATUS

[76] Inventor: Ray A. Brennan, Rte. 1, Box 575, Lake Geneva, Wis. 53147

[21] Appl. No.: 214,085

[22] Filed: Dec. 8, 1980

[51] Int. Cl.[3] ..... B03B 4/00

[52] U.S. Cl. ..... 209/466; 209/486; 209/493; 209/502; 209/506

[58] Field of Search ..... 209/1, 3, 466–469, 209/471, 474, 475, 486, 493, 487, 502, 506

[56] References Cited

U.S. PATENT DOCUMENTS

| | | | |
|---|---|---|---|
| 1,212,393 | 1/1917 | Payne | 209/467 |
| 1,864,184 | 2/1932 | Cleaver | 209/467 X |
| 1,945,526 | 2/1934 | Gibson | 209/466 X |
| 1,948,800 | 2/1934 | Revelart | 209/467 |
| 2,155,235 | 4/1939 | Morgan et al. | 209/486 X |
| 2,291,044 | 7/1942 | Kennedy | 209/486 X |
| 2,798,607 | 7/1957 | Hoffman | 209/467 |
| 3,065,853 | 11/1962 | Binnix | 209/468 |
| 3,777,887 | 11/1973 | Johnston | 209/486 X |

*Primary Examiner*—Ralph J. Hill
*Attorney, Agent, or Firm*—Howard H. Darbo

[57] ABSTRACT

Virgin ore in granular form is enriched by air flotation classification separating at least a large part of the gangue. Suspension of the ore is effected immediately as supplied to the inlet section of the classification trough by copious upward flow of air from the air-diffusing floor plates after which separation is accomplished as the suspension flows through the trough. An adjustable gate in the partition which separates the inlet section of the plenum from the classifier section is adjusted to maintain a relatively very high pressure and consequent copious air flow as compared with the pressure of the plenum from which air is supplied in more moderate quantities to the diffuser floor of the classification trough downstream of the partition. The trough is free of any obstruction that would impede the flow of gangue to its discharge end. Flotation air is supplied to the plenum only at the inlet section and a bleeder valve regulates the total flow to the air-diffusing floor plates of the apparatus. Either cross or longitudinal riffles may be employed in the trough floor as required to handle particular materials. The latter also offering continuous operation which may be enhanced by a shaker or vibrating conveyor action to move settled ore toward the discharge end of the apparatus.

10 Claims, 11 Drawing Figures

16
16
1
30
34
29
30
23
21
27
26
24
25
27
20
22
36
28
27a
17
27
18
18
9
19
14
3
3
4a
15
12
13
14
4

AIR FLOTATION ORE ENRICHING APPARATUS

BACKGROUND AND SUMMARY OF THE INVENTION

Only mineral deposits with sufficient metalliferous content can be economically mined and processed to produce the metallic constituents. Marginal ores, old tailings, or even good ores, can be enriched to provide a more desirable raw material for the smelting or refining processes. Flotation processes, both liquid and air, have long been used to separate at least a large part of the gangue from the virgin ore to effect the desired enrichment of the ore for further processing. The general object of this invention is to provide improved air flotation apparatus for enriching ore which is, or has been reduced to, small particles similar in size, roughly, to natural sands.

Apparatus of this type is described in Hoffman U.S. Pat. No. 2,798,607. This apparatus has proved to be without commercial utility, however, partly because of impedance of the flow of the flotation suspension by blades intended to laterally divert and discharge the floating gangue, this interference tending to clog the stream and prevent operation of the apparatus. Excessive care also had to be taken to prevent choking of the apparatus at the inlet end by the ore being fed from a hopper. Also, even when subjected to vibration, the herringbone pattern of riffle grooves does not dependably carry away separated valuable ore. Although Hoffman provides means for separately controlling the flow of air to the feed section, the intermediate deck, and the discharge section of his separation trough, respectively, he apparently contemplates the maintenance of equal air pressures under each section in the operation of his apparatus or, at most,to adjust air to compensate for the changing load of solids carried in the flotation stream.

It must be recognized that to be successful the air flotation process that is carried out with a particular apparatus must be adapted to the pertinent characteristics of the ore to be processed as it is fed to the apparatus. Since the flotation characteristics of the particles fed to the apparatus depends upon the densities of the particles and their dimensions and shapes, the enriching apparatus must be adapted to the flotation conditions required to separate gangue from the valuable ore in each raw material mixture. Most important, the upward air flow through the classification trough floor must be sufficient to effect the essential suspension of at least the gangue particles. In the apparatus of the instant invention, this is accomplished in two stages, the first being the immediate air impregnation and suspension of the mass of mixed particles as fed to the inlet section of the trough from a hopper, the second stage providing maintenance of the suspension so that the fluidized body flows through the trough to its discharge end as the less buoyant valuable ore settles in the riffles of the floor plates and the floating gangue is separated and discharged. The enrichment of the ores by separation of the gangue from the value particles is comparatively easy and efficient when operating upon a mixture in which a comparatively large differential exists between the "buoyancy" of the gangue particles and of the value particles. A more exacting control of the rate of upward flow of the flotation air is required to separate particles which have comparatively similar flotation or buoyancy characteristics.

The object of the present invention is to provide air flotation apparatus for enrichment of ore in particle form by separation of at least a substantial part of the gangue, the apparatus embodying air flow control means for supplying flotation air in relatively very copious quantities to the inlet section of the separation trough to effect immediate impregnation without time lag and flotation of the ore particles as the raw material is supplied to the apparatus while providing a relatively greatly reduced flow of flotation air to the classification section of the trough. The trough is entirely unimpeded to the flow of the fluidized body throughout the length thereof to avoid any interruption to the generally uniform and continuous flow of the suspension through the apparatus.

A further object is to provide such enrichment apparatus wherein the floor is composed of a succession of modular, adjoining air-diffusing plates providing either crosswise or lengthwise riffles to trap the value particles as may be best adapted to the processing of a particle raw material mixture. The crosswise riffle orientation is usually employed in batch operation while the lengthwise orientation, advantageously with a shaker or vibrating conveyor device, may be operated continuously.

A further object is to provide such apparatus which may be adapted to the efficient processing of ores containing heavy metal components, such as lead or gold, by forcing flow of diffused flotation air through the bottom portions of even partly filled riffle troughs by sealing over the peak areas between the riffles of the floor plates.

THE DRAWINGS

In the accompanying drawings.

DESCRIPTION OF PREFERRED EMBODIMENTS OF THE INVENTION

Figure 1:
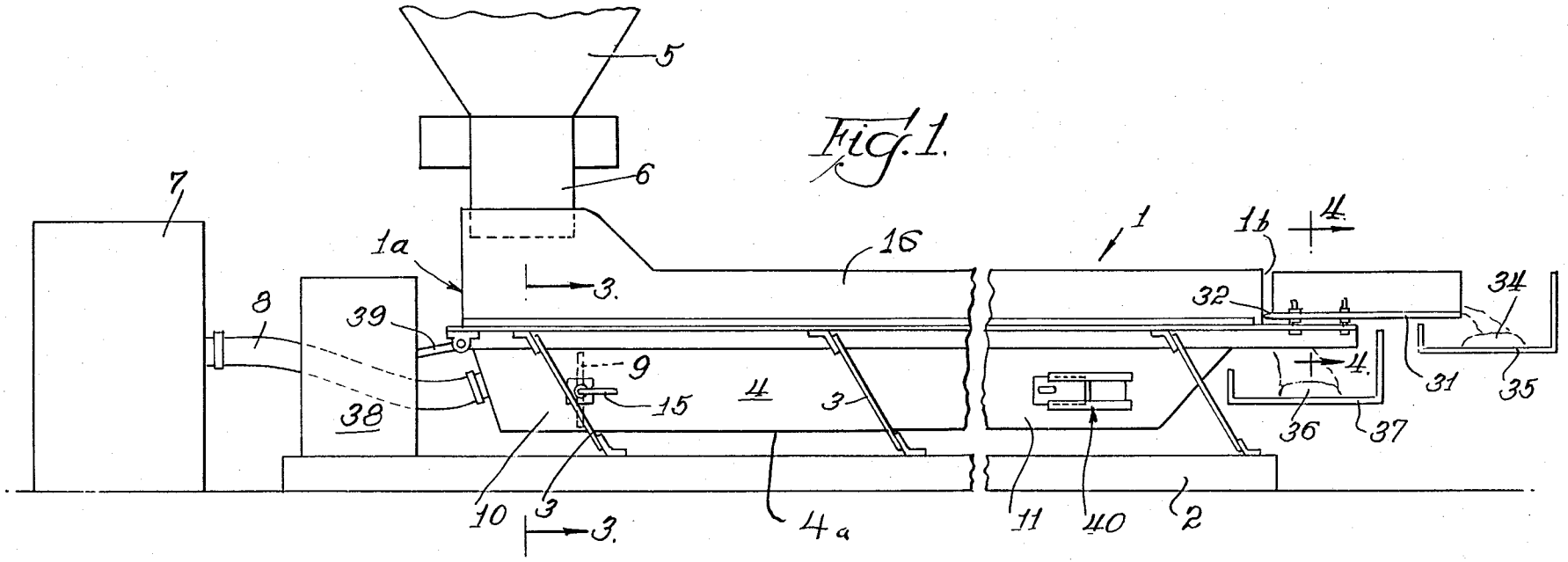
FIG. 1 is a side elevational view of the ore enriching apparatus of the invention.

Two alternative embodiments of the ore enriching apparatus are illustrated and described. Both employ an air flotation classification trough having an air-diffusing floor with riffled surfaces and means for continuously supplying air under pressure to the floor plates and ore in particulate form, all as in known dry or air flotation ore classification processes. The apparatus of FIGS. 1–6, including a conveyor-type shaker and having lengthwise oriented riffle troughs, is designed for continuous operation while the apparatus of FIGS. 7–9, with crosswise riffles, is intended for batch operation.

Referring, first, to the apparatus of FIGS. 1–6, a classification trough 1 is supported over a base 2 by means of spaced struts 3. An enclosure 4a forming a plenum chamber 4 is supported from and under trough 1, extending the length of the floor of the trough. A hopper 5 having an outlet spout 6 is mounted above the trough at its inlet end 1a to feed pulverized virgin ore or other raw material to be processed by the enriching apparatus.

Figure 3:
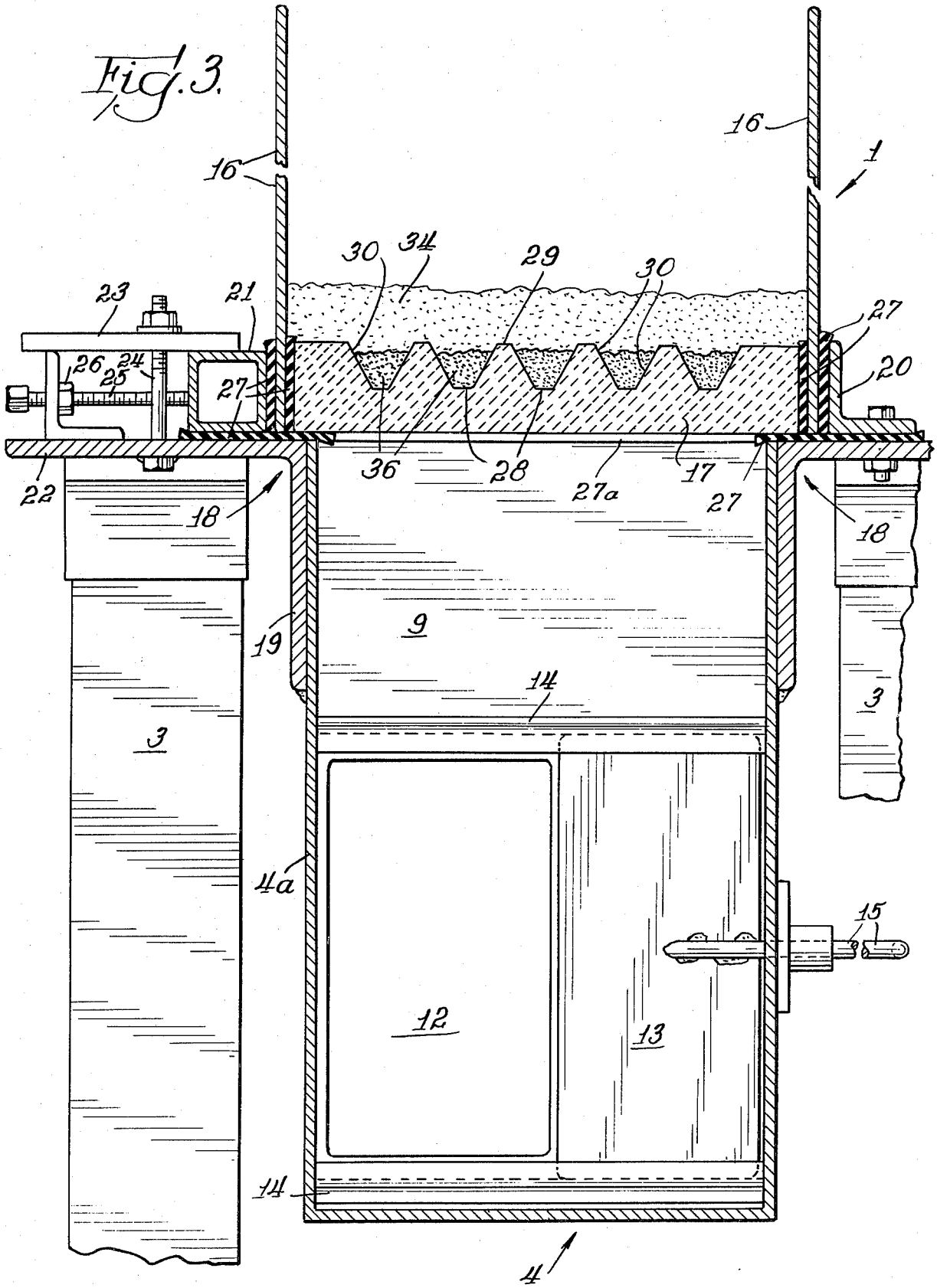
FIG. 3 is a cross-sectional view of the apparatus taken at the line 3—3 of FIG. 1.
Figure 4:
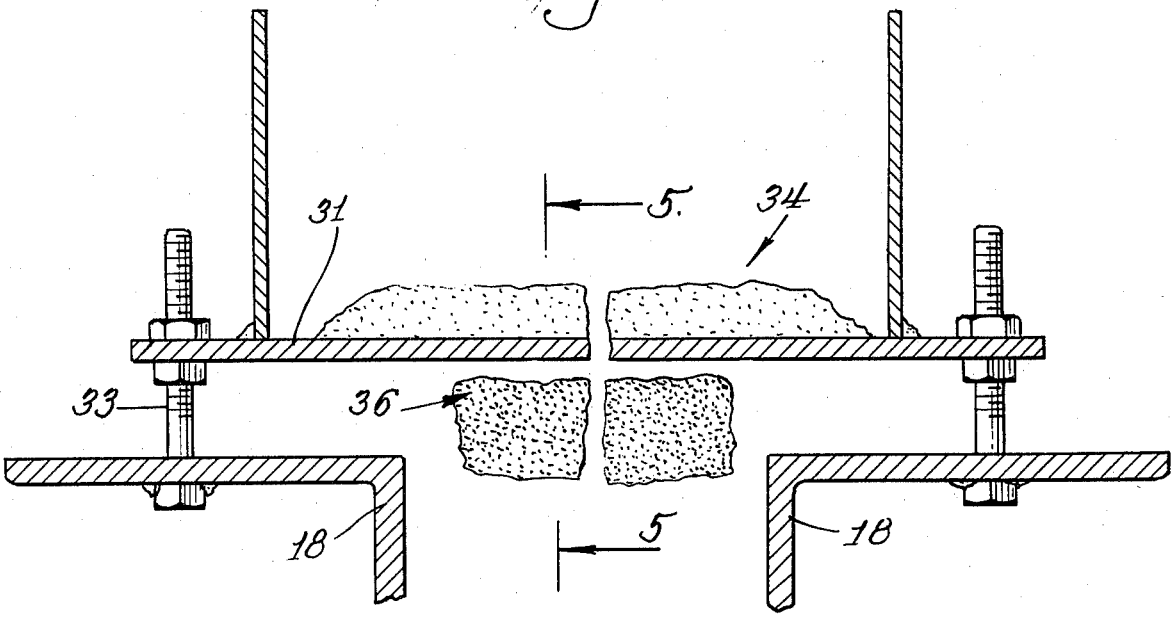
FIG. 4 is a detail view in cross section taken at the line 4—4 of FIG. 1.
Figure 5:
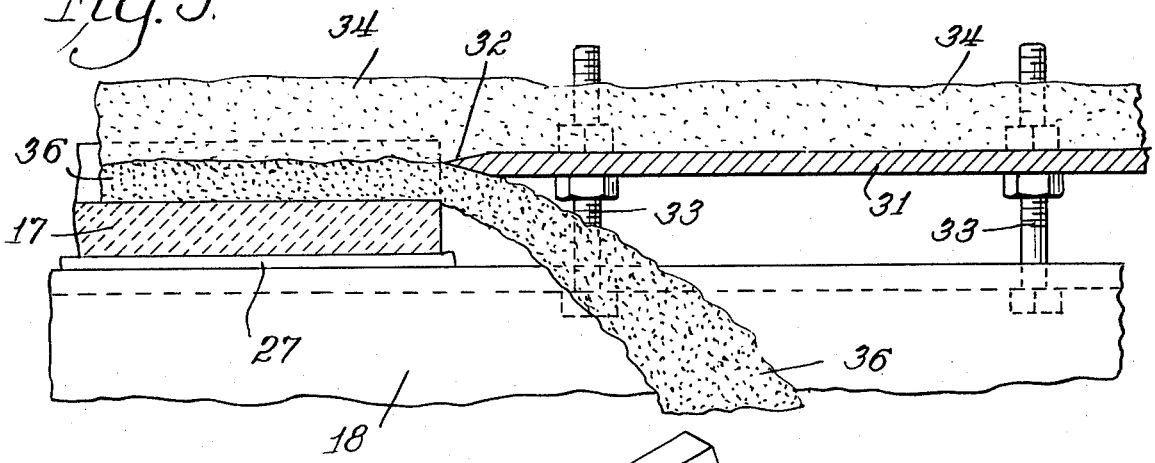
FIG. 5 is a detail view in cross section taken at the line 5—5 of FIG. 4.
Figure 6:
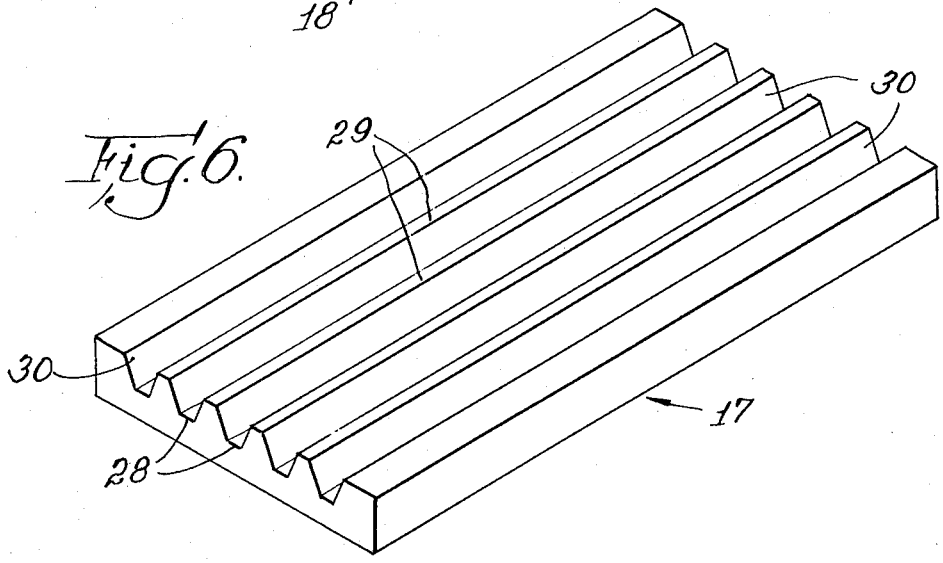
FIG. 6 is a perspective view of a typical air-diffusing floor plate.

A positive blower 7, such as the "Roots" blower, is connected by means of a suitable conduit 8 to the plenum chamber 4 at the end thereof under the inlet end of the classification trough 1. A partition 9 divides the plenum chamber 4 into an inlet plenum 10 and a classification plenum 11. As is best seen in FIG. 3, partition 9 has an opening 12 therein and an adjustable valve gate 13 suitably mounted in ways 14 to be slidable for partly closing opening 12 to restrict the flow of air therethrough for purposes hereinafter more fully described. Valve gate 13 may be adjusted externally of the apparatus by means of a sliding handle 15.

Classification trough 1 comprises sides 16 which are sufficiently high to provide adequate depth of trough to contain the fluidized flotation suspension and guide the flow of the suspension stream to the discharge end 1b of the classification apparatus. The floor of the trough is composed of a plurality of interstitial cellular plates 17. The trough structure, including its floor of plates 17, is supported by a pair of angle iron bars 18 which, in turn, are supported above base 2 by struts 3. As is seen in FIG. 3, the structure 4a forming the plenum chamber 4 is welded to the vertical legs 19 of the angle iron bars.

As is also shown in detail in FIG. 3, the floor plates 17 and the trough sides 16 are clamped in position between a fixed angle iron bar 20 and a movable bar 21. Strips 27 of neoprene or similar material are placed on both sides of the bottom portions of sides 16 and upon legs 22 of angles 18 as shown to seal against the escape of air and to protect the edges of the ceramic floor plates against crushing damage. Bar 21 is movable between the neoprene strip on leg 22 of angle iron bar 18 and a parallel plate 23. A bolt 24 retains plate 23 in position and a set screw 25, threaded in a flange 26 which is affixed to angle iron leg 22, bears against bar 21 to clamp the trough assembly together. Set screw 25 is tightened sufficiently to ensure against air leakage past the plates from the plenum chamber or movement of the plates due to the air pressure exerted against them by the air under pressure in the plenum chamber. When clamped in the manner described, the soft neoprene conforms to the uneven surfaces of floor plates 17.

Floor plates 17 are preferably cast from ceramic material to form interstitial, cellular bodies through which air can pass when applied under pressure to undersurfaces of the plates. Air-diffusing plates of this type are known in the art. For air flotation classification purposes, the plates are formed with top surfaces with closely spaced straight, parallel riffle troughs 28, separated by peak areas 29, the sides 30 of the riffles being sloping as indicated. The floor plates are rectangular so that the floor of a classification trough may be assembled from the necessary number of plates arranged contiguously throughout the length of the trough. In the ore enriching apparatus illustrated in FIGS. 1–6, the plates are arranged with the riffle troughs on their riffled surfaces oriented lengthwise of the classification trough so that each riffle trough is continuous from the inlet end to the discharge end of the classification trough. Strips of neoprene or similar material are inserted between adjacent plates below the level of the riffle troughs to engage the plate edge surfaces and securely hold them in position and seal the joints against the flow of air past the plates.

A generally horizontal separating plate 31 is mounted upon angle iron bars 18. The leading edge 32 of the separating plate is positioned at approximately the interface between the enriched ore and the suspended gangue, the position of the plate being adjustable by reason of the threaded mounting bolt 33. As is indicated in the drawing, the floating gangue 34 is skimmed off by the separating plate 32 and discharged onto a conveyor 35 for disposition while the enriched ore 36 passed under the separating plate and onto conveyor 37 for collection or further processing.

To continuously convey settled enriched ore downstream towards the discharge end of the classification trough, a means 38 for vibrating a declined trough or shaking a horizontal trough with vibrating conveyor action may be employed. Known driving mechanisms of this type such as the "Ajax" vibrating shaker may be used. When securely mounted upon the stationary base and connected with the classification trough 1 at its inlet end by means of connecting rods 39, reciprocating movement of the connecting rods, acting in conjunction with struts 3 which are inclined toward the inlet end of the classification trough, provides a conveyor action that keeps enriched ore particles moving downstream toward the discharge end of the classification trough by shaking the particles upwardly and forwardly with each forward movement of the reciprocating rods 39.

To promote movement of both the settled particles of enriched ore and the suspended gangue stream, the classification trough may be tilted to slope downwardly towards its discharge end. Also, separating plate 31, either along with or independently of the classification trough, may be arranged to slope downwardly in the downstream direction to promote the flow of the separated gangue along the upper surface of the separating plate.

Figure 2:
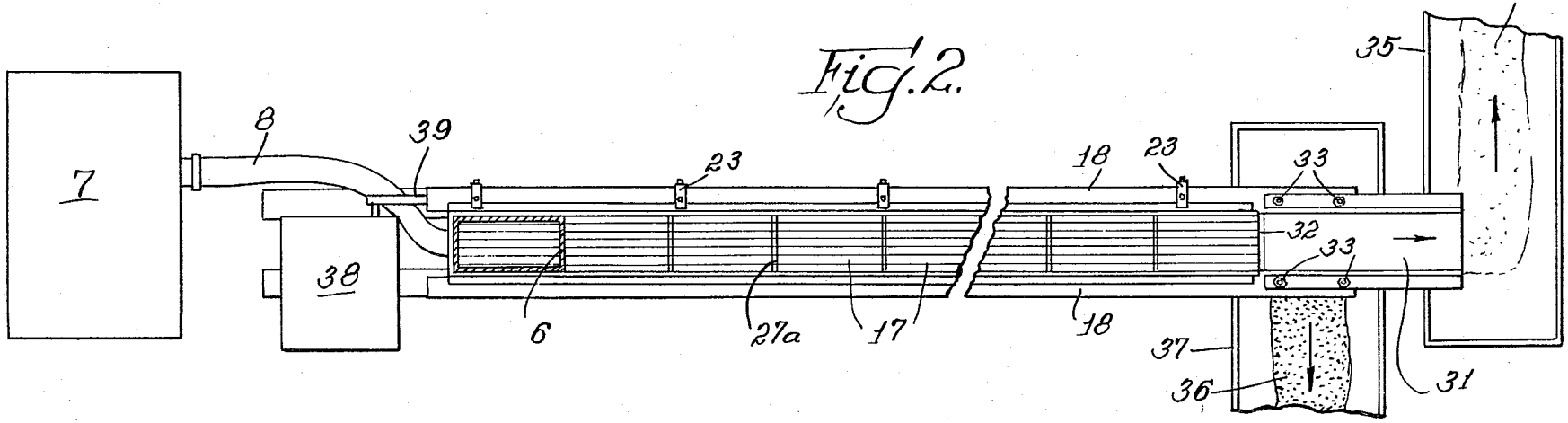
FIG. 2 is a plan view of such apparatus wherein the classification trough is provided with floor plates oriented to provide lengthwise riffle troughs.

In the operation of the ore enriching apparatus of FIGS. 1–6, the mixture of pulverized ore to be processed is continuously fed from hopper 5 to the inlet end portion of classification trough 1 as indicated in FIGS. 1 and 2. Flotation air supplied by blower 7 is directed upwardly from inlet plenum 10 through the floor plates of this portion of the trough in quantities sufficient to immediately impregnate the incoming ore and effect the suspension of the particles at this source of the flotation stream. Preferably, the inlet end portions 16a of the sides of the trough are higher to ensure containment of the turbulent air and ore particles in this inlet end of the apparatus.

At the same time, air is continuously supplied to the remainder of the floor plates from classification plenum 11. It will be understood that air flow must be controlled for each particular enrichment job to keep the process operating and under control. The total amount of air supplied to and passing through the cellular floor plates may be controlled by adjusting the speed, and thus the output, of blower 7. If, as is shown in the apparatus illustrated in FIGS. 1 and 2, a single-speed blower is employed, the total amount of air supplied to the classification trough may be adjusted by means of bleed valve 40 in the wall of classification plenum 11. The entire output of blower 7 must pass through the classification trough floor plates when valve 40 is closed and if lesser volumes are desired, bleed valve 40 may be adjusted to partial or full open position.

As already noted, the amount of air required to immediately separate and suspend the particles of the ore mixture as it is fed to the classification trough is very much greater than that required to merely maintain the suspension of the gangue particles as the flotation stream moves through the trough to its discharge end while the valuable ore particles are permitted to settle in the riffle troughs of the floor plates. Given the proper total quantities of air required to operate the apparatus in processing a particle ore mixture, the necessary proportioning of incoming air to the inlet section and to the classification section is controlled by valve gate 13. By restricting opening 12, the pressure, e.g. 4.0 p.s.i., necessary to force air through the floor plates of the inlet section of the apparatus in the very large quantities needed to almost instantaneously and continuously impregnate the mass of particles being fed to the apparatus from the hopper is maintained. The setting of valve gate 13 also determines the driving pressure, say 0.5 p.s.i., and thus the amount of air flowing through the diffuser plates to the classification trough above plenum 11. Once equilibrium is achieved for optimum operation of the ore enriching apparatus, continuous operation is possible with only minor adjustments necessitated by variations in the rate of feed of the ore mixture to the apparatus or variations in the physical composition of the material.

Figure 7:
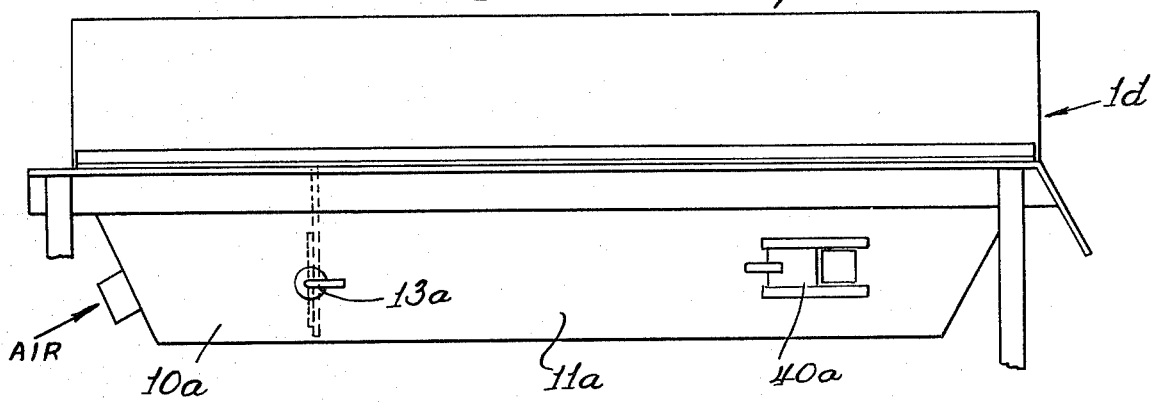
FIG. 7 is a side elevational view of an ore enriching apparatus designed for batch operation.
Figure 8:
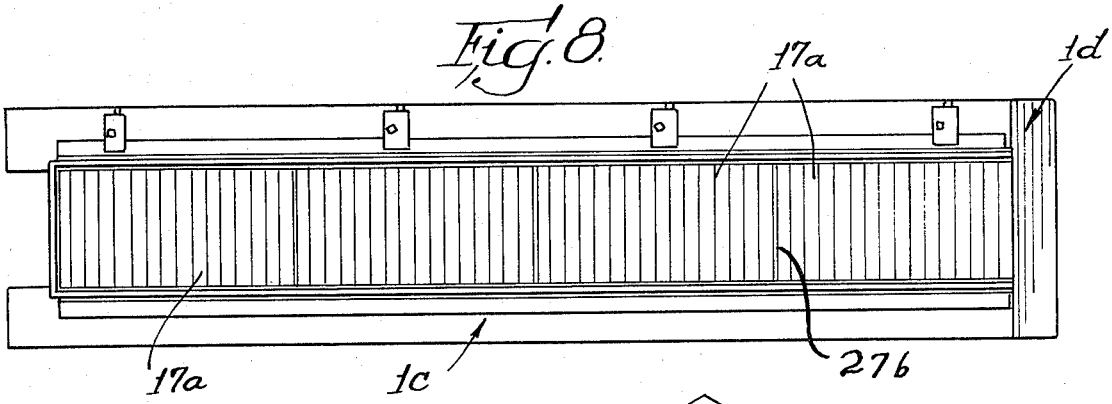
FIG. 8 is a plan view of the apparatus of FIG. 7.
Figure 9:
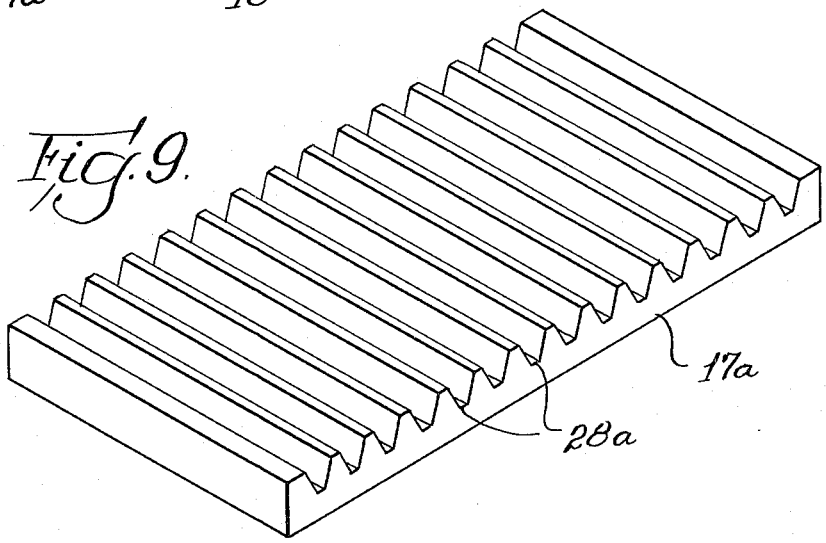
FIG. 9 is a perspective view of an air-diffusing floor plate as used in the apparatus of FIGS. 7 and 8, and FIGS. 10 and 11 are detail views, in cross section, showing modified forms of the floor plates.

The ore enriching apparatus is designed to handle the widest possible range of ore materials. The apparatus illustrated in FIGS. 7–9 is designed to handle relatively small quantities of ore in batches. The structure is similar to that previously described except that the floor plates 17*a* are oriented with the riffle troughs 28*a* crosswise of the classification trough 1*c* and gasket cushioning strips 27*b* of neoprene are inserted between adjacent plates. The value particles fall into the riffle trough and are removed during shutdown by a vacuum machine. There is no need or use for a shaker. The flotation air plenum structure is similar to that already described with proportioning of air to inlet plenum 10*a* and classification plenum 11*a* being controlled by valve 13*a*. The total volume of air from the supply blower that is utilized in the flotation classification process may be controlled by bleeder valve 40*a*. Separated gangue is discharged at discharge end 1*d* of the classification trough.

Figure 10:
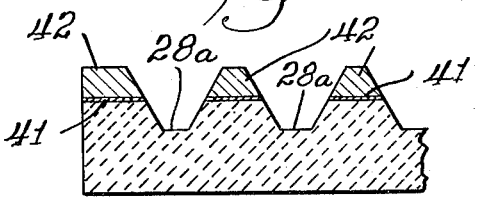

To avoid interference with the desired settling of value particles when heavy metallic ores are being processed, it is sometimes desirable to seal off the crest surface areas 41 between the riffle troughs 28*a* to force flotation air to flow in adequate quantities upwardly in, and in the spaces above, the riffle troughs. To this end, these crest surface areas may be sealed or covered by solid elements as, for example, the wooden strips 42 illustrated in the detail view of FIG. 10. This expedient ensures desirable looseness of settled particles of gangue materials in the riffle troughs and permits settling therethrough of the still heavier value metallic components. For example, in separating gold from at least a substantial part of black sand gangue, it is desirable to make it possible for the gold particles to sink through black sand that may have settled in the riffle troughs to facilitate the desired separation.

Figure 11:
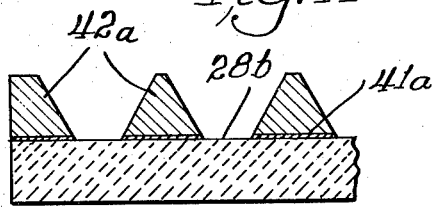

An alternative form of floor plate is shown in cross section detail in FIG. 11. The cellular ceramic plate has a flat top surface through which air may flow and the riffle troughs 28*b* are formed by spaced parallel strips 42*a* of wood or other suitable material cemented to the top surface of the plate. Since in this form of the plate, the upward flow of flotation air is confined to the bottoms of the troughs, the strips should be spaced somewhat further apart to provide troughs having wider bottoms than those formed integrally with the ceramic plates.

ACHIEVEMENTS

The ore enriching apparatus of this invention offers great flexibility of application as is required to handle a wide variety of ore mixtures and effect a reasonable separation of gangue from the value ore. Most important, the flotation air control means is capable of adjustment to immediately impregnate and suspend incoming ore mixtures and thereafter maintain the suspension necessary to the classificaton process as required by the characteristics of the gangue and the value ore particles. The apparatus is simple and dependable.

I claim:

1. In a flotation ore enriching apparatus including a classification trough having an air-diffusing floor composed of interstitially cellular ceramic material having spaced riffle traps in the top surface thereof, a plenum chamber subjacent and opening to said floor to supply flotation air thereto, means for continuously supplying air under pressure to said plenum chamber, means for continuously supplying pulverized gangue and value ore mixture to be enriched to the inlet end of said classification trough, and means for controlling the flow of flotation air to said classification trough, the improvement wherein said means for continuously supplying air consists of a positive blower, said plenum chamber contains a partition defining within said chamber an inlet plenum located subjacent the inlet end of said trough and a classification plenum subjacent the remainder of said trough downstream from said inlet end thereof, said blower being connected to discharge only into said inlet plenum, said means for controlling the flow of air consisting essentially of an adjustable bleeder valve in a wall of said classification plenum to control the total volume of air forced through said air-diffusing floor and adjustable valve means in said partition to impede the flow of air from said inlet plenum to said classification plenum to maintain a high pressure in said inlet plenum sufficient to force sufficient air through said inlet end of said trough to impregnate and suspend the ore as it is being fed to said trough while maintaining by means of said bleeder valve a relatively low pressure in said classification plenum.

2. Apparatus in accordance with claim 1 wherein said valve means in said partition includes a handle extending outside of said plenum chamber for external adjustment manipulation of said valve.

3. Apparatus in accordance with claim 1 wherein said air-diffusing floor comprises a plurality of rectangular interstitially cellular ceramic riffled plates whereby said classification trough is readily convertible from one with crosswise-riffled floor to one with lengthwise-riffled floor.

4. Apparatus in accordance with claim 1 wherein said air-diffusing floor comprises riffled plates oriented with the riffles therein arranged crosswise of said classification trough.

5. Apparatus in accordance with claim 1 wherein said air-diffusing floor comprises interstitially cellular ceramic riffled plates with the riffle troughs thereof arranged lengthwise of said classification trough and wherein said apparatus includes a shaker operatively connected with said classification trough to impel value components of the ore which have settled to the floor of said classification trough toward the discharge end thereof.

6. Apparatus in accordance with claim 5 and including a generally horizontal separating plate adjustably disposed at the discharge end of said classification trough with the leading edge thereof facing upstream into said classification trough at approximately the interface between the enriched ore and the suspended gangue to separate the components of the mixture supplied to said classification trough.

7. Apparatus in accordance with claim 1 wherein said air-diffusing floor comprises interstitially cellular ceramic riffled plates and the crest surface areas betwen the riffle troughs are sealed to the passage of air whereby to force additional flow of flotation air through the riffle trough surfaces.

8. Apparatus in accordance with claim 1 wherein said air-diffusing floor comprises riffled plates oriented with the riffles therein arranged lengthwise of said classification trough.

9. Apparatus in accordance with claim 8 wherein said trough slopes downwardly from said inlet end to the discharge end thereof.

10. Apparatus in accordance with claim 9 and including a generally horizonatal separation plate adjustably disposed at the discharge end of said classification trough with the leading edge thereof facing upstream into said classification trough at approximately the interface between the enriched ore and the suspended gangue to separate the components of the mixture supplied to said classification trough.

* * * * *